US009843872B2

(12) United States Patent
Liao et al.

(10) Patent No.: US 9,843,872 B2
(45) Date of Patent: Dec. 12, 2017

(54) SOUND COLLECTION EQUIPMENT AND METHOD FOR DETECTING THE OPERATION STATUS OF SOUND COLLECTION EQUIPMENT

(71) Applicant: Unlimiter MFA Co., Ltd., Eden Island (SC)

(72) Inventors: Ho-Hsin Liao, Taipei (TW); Kuan-Li Chao, Taipei (TW); Neo Bob Chih-Yung Young, Taipei (TW); Kuo-Ping Yang, Taipei (TW); Jian-Ying Li, Taipei (TW); Po-Jui Wu, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 15/213,468

(22) Filed: Jul. 19, 2016

(65) Prior Publication Data

US 2017/0325032 A1 Nov. 9, 2017

(30) Foreign Application Priority Data

May 4, 2016 (TW) ..... 105113889 A

(51) Int. Cl.
*H04R 25/00* (2006.01)

(52) U.S. Cl.
CPC ..... *H04R 25/30* (2013.01); *H04R 25/453* (2013.01); *H04R 25/558* (2013.01)

(58) Field of Classification Search
CPC ..... H04R 25/30; H04R 25/453; H04R 25/558
See application file for complete search history.

(56) References Cited

U.S. PATENT DOCUMENTS

2004/0196992 A1* 10/2004 Ryan ..... H04R 1/10 381/312

* cited by examiner

*Primary Examiner* — Mark Fischer
(74) *Attorney, Agent, or Firm* — Bacon & Thomas, PLLC

(57) ABSTRACT

A sound collection equipment includes a speaker, a microphone and a processing unit. The speaker is used for generating a test sound. The microphone is used for receiving the test sound. The processing unit is electrically connected to the microphone and the processing unit. The processing unit is used for determining if the energy of the test sound exceeds a predetermined energy value and judging that the sound collection equipment is in a usage state when the test sound does not exceed the predetermined energy value.

10 Claims, 4 Drawing Sheets

SOUND COLLECTION EQUIPMENT AND METHOD FOR DETECTING THE OPERATION STATUS OF SOUND COLLECTION EQUIPMENT

BACKGROUND OF THE INVENTION

1. Field of the Invention

The present invention relates to a sound collection equipment and a method for detecting an operation status of a sound collection equipment, in particular to a sound collection equipment having both a speaker and a microphone and the method for detecting an operation status of a sound collection equipment.

2. Description of the Related Art

Typically, when a user uses a sound collection equipment such as a hearing aid, the speaker generates annoying high frequency sounds when the microphone is too close to the speaker. This phenomenon, referred to as audio feedback, generally occurs unintentionally when the microphone and the speaker are in close proximity to each other during operation, and the high frequency sound can startle users and generate unpleasant user experiences.

Therefore, it is desirable to provide a method to reduce or eliminate the audio feedback phenomenon in order to resolve the above mentioned issue.

SUMMARY OF THE INVENTION

The objective of the present invention is to provide a sound collection equipment and a method to detect the operating state of the sound collection equipment.

In order to achieve the above objective, the sound collection equipment of the present invention comprises a speaker, a microphone and a processor unit. The speaker is used for generating a test sound. The microphone is used for receiving the test sound. The processor unit is electrically connected to the speaker and the microphone. The processor unit is used for determining if the energy of the test sound received by the microphone exceeds a predetermined energy value and judging that the sound collection equipment is in use if the energy does not exceed the predetermined energy value.

The method for detecting the operating state of a sound collection equipment according to the present invention comprises a speaker and a microphone. The method for detecting the operating state of a sound collection equipment according to the present invention includes the following steps: generating a test sound via the speaker, receiving the test sound via the microphone, and determining if the energy of the test sound received by the microphone exceeds a predetermined energy value; if the energy of the test sound does not exceed a predetermined energy value, judging that the sound collection equipment is in a usage state; and if the energy of the test sound exceeds a predetermined energy value, judging that the sound collection equipment is not in the usage state.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

The following embodiments are provided in order to further explain the implementations of the present invention. It should be noted that the objects used in the diagrams of the embodiments are provided with proportions, dimensions, deformations, displacements and details as examples and that the present invention is not limited thereto; identical components in the embodiments are the given same component numbers.

Figure 1:
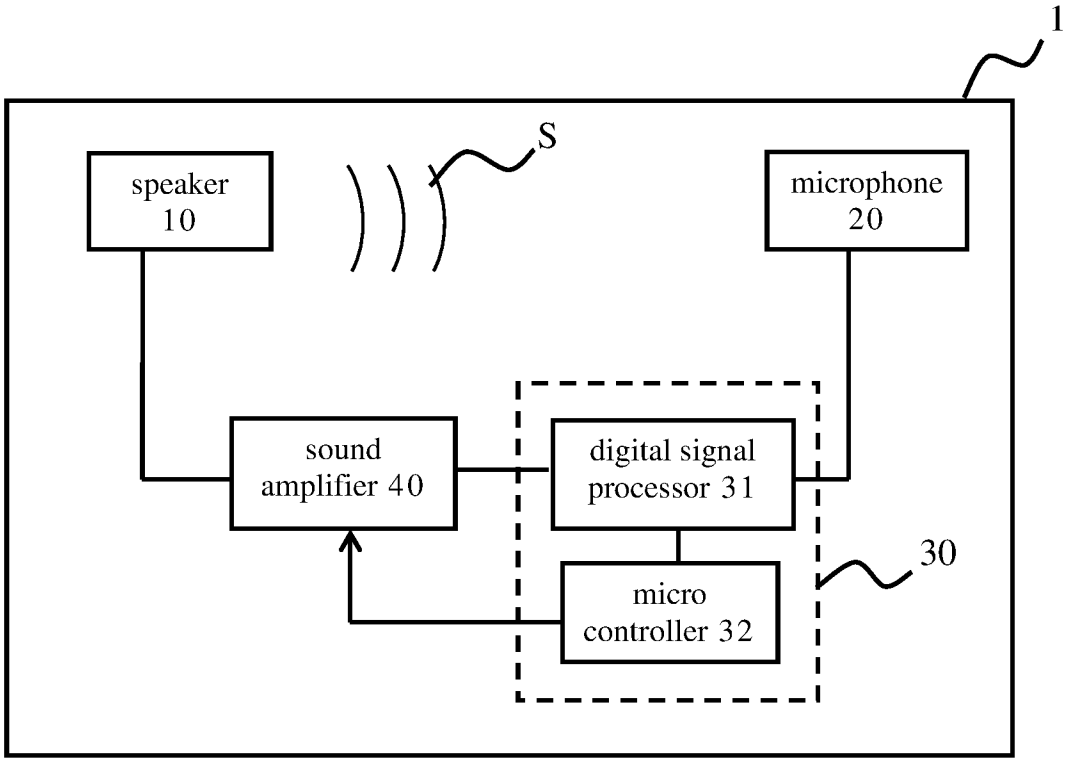
FIG. 1 is a device architecture diagram of the sound collection equipment of the present invention.

FIG. 1 is a device architecture diagram of the sound collection equipment of the present invention As shown in FIG. 1, in an embodiment of the present invention, a sound collection equipment 1 of the present invention comprises a speaker 10, a microphone 20, a processor unit 30 and a sound amplifier 40. In a specific embodiment of the present invention, the sound collection equipment 1 is a hearing aid, but the scope of the present invention is not limited thereto.

In an embodiment of the present invention, the speaker 10 is used for generating a high frequency test sound S, wherein the frequency of the test sound S preferably ranges between 8,000~40,000 Hz and the loudness does not exceed 20 dB, but the scope of the present invention is not limited thereto.

In an embodiment of the present invention, the microphone 20 is used for receiving external sounds, including a test sound S generated by the speaker 10. After the test sound is transmitted to the microphone 20, the microphone 20 can generate an input sound signal, and the input sound signal is transmitted to the processor unit 30 for processing.

In an embodiment of the present invention, the processor unit 30 is electrically connected to the speaker 10 and the microphone 20. The processor unit 30 comprises a digital signal processor 31 and a micro controller 32.

The digital signal processor 31 is used for processing the input sound signal transmitted from the microphone 20 to generate a corresponding output sound signal. The output sound signal is transmitted to the sound amplifier 40.

The micro controller 32 is used for determining whether the energy of the test sound S received by the microphone 20 exceeds a predetermined energy value and judging that the sound collection equipment 1 is in a usage state after determining that the energy of the test sound S does not exceed the predetermined energy value. Oppositely, the micro controller 32 judges that the sound collection equipment 1 is not in the usage state when the micro controller 32 determines that the energy of the test sound S exceeds the predetermined energy value. When the micro controller 32 judges the sound collection equipment 1 is not in the usage state, the micro controller 32 further controls the sound amplifier 40 to stop amplifying sounds received by the microphone 20 or to reduce an amplified level of the sounds received by the microphone 20. The operating state of the sound collection equipment 1 is explained in detail in the following paragraphs and thus is not provided here.

The sound amplifier 40 is electrically connected to the processor unit 30. The sound amplifier 40 is used for amplifying the output sound signal generated by the digital signal processor 31 of the processor unit 30 and transferring the amplified output sound signal to the speaker 10 so that the speaker 10 plays sounds according to the amplified output sound signal.

Figure 2:
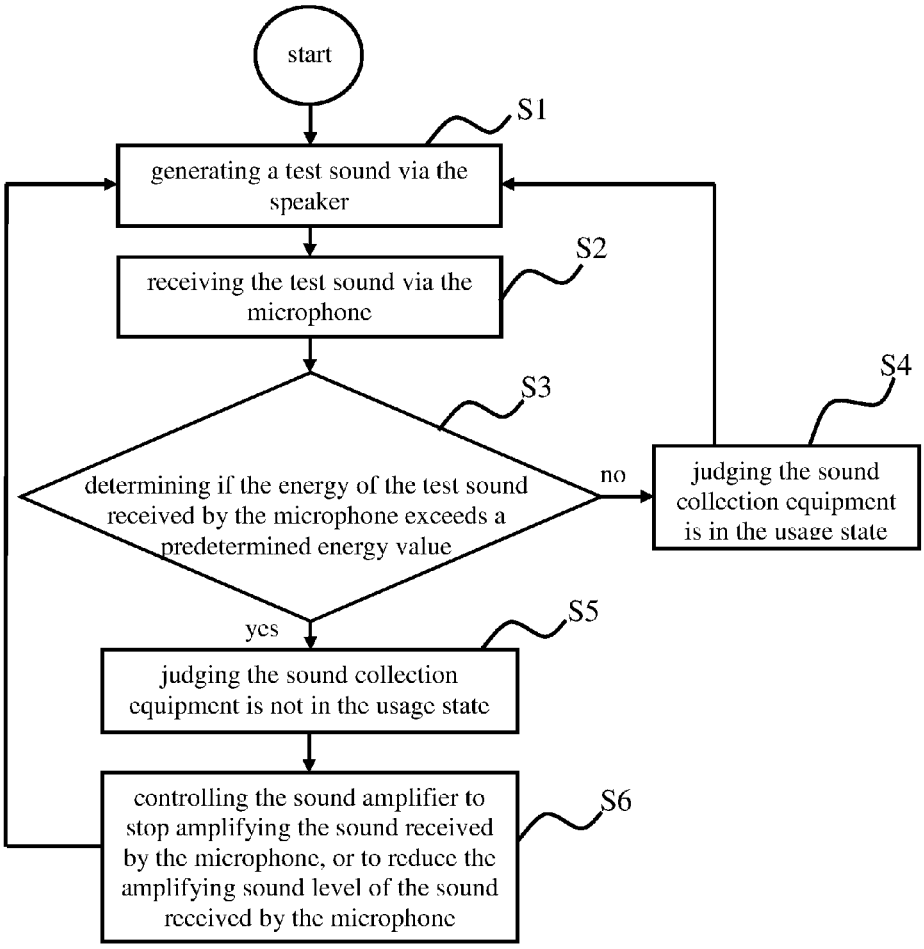
FIG. 2 is a step flowchart of a method for detecting an operating state of a sound collection equipment of the present invention.

Next, refer to FIG. 1 to FIG. 6, wherein FIG. 2 is a step flowchart of a method for detecting an operating state of a sound collection equipment according to the present invention. The steps shown in FIG. 2 are further presented in detail in FIG. 1, FIG. 3 and FIG. 6. It should be noted that the following implementation is based on the sound collection equipment 1 described previously to illustrate the method for detecting an operating state of a sound collection equipment according to the present invention. However, the scope of the method for detecting an operating state of a sound collection equipment according to the present invention is not limited to the sound collection equipment 1 described previously.

First, executing step S1: generating a test sound via the speaker.

The method for detecting an operating state of a sound collection equipment of the present invention is applicable to a sound collection equipment 1 and is used for detecting if the sound collection equipment 1 is in use. In the first step of the method, the micro controller 32 of the processor unit 30 controls the speaker 10 to generate a test sound S.

Executing step S2: receiving the test sound via the microphone.

When step S1 is completed, the microphone 20 of the sound collection equipment 1 receives the test sound S generated by the speaker 10.

Executing step S3: determining if the energy of the test sound received by the microphone exceeds a predetermined energy value.

After the microphone 20 receives the test sound S, the micro controller 32 of the processor unit 30 determines if the energy of the test sound received by the microphone 20 exceeds a predetermined energy value (for example: 10 dB).

Figure 3:
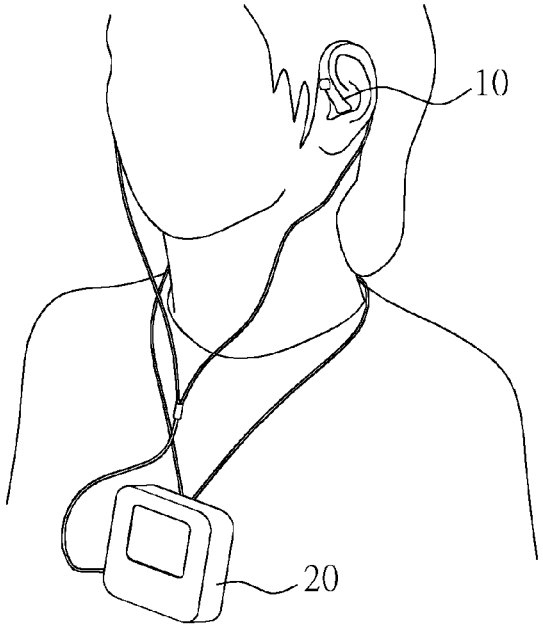
FIG. 3 is a schematic diagram of the first embodiment indicating that the electronic device is in a usage state.
Figure 4:
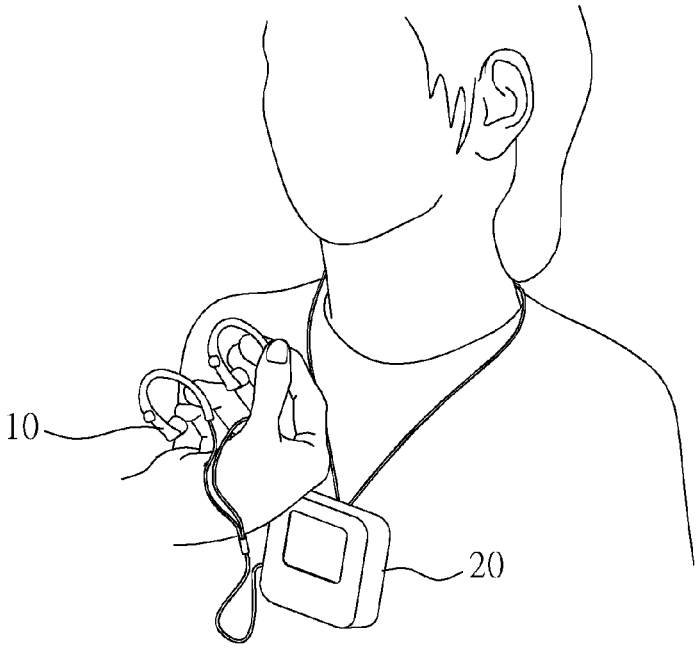
FIG. 4 is a schematic diagram of the first embodiment indicating that the electronic device is not in a usage state.

As shown in FIG. 1 and FIG. 3, in an embodiment of the present invention, when a user uses the sound collection equipment 1, i.e., the sound collection equipment 1 is in a usage state, the speaker 10 of the sound collection equipment 1 is placed near the ears of the user, and the microphone 20 hangs on the user's chest. Accordingly, the distance between the speaker 10 and the microphone 20 is equal to or greater than a certain distance. As shown in FIG. 4, when the user does not use the sound collection equipment 1 and wants to store the sound collection equipment 1, the microphone 20 frequently is placed at less than the certain distance from the speaker 10 in order to reduce the required storage space. Therefore, the sound collection equipment 1 being in the usage state refers to the speaker 10 being at a predetermined distance (for example: 60 cm or more) from the microphone. Because the sound collection equipment 1 is in the usage state, the distance between the speaker 10 and microphone 20 is equal to or greater than the predetermined distance. Thus, the energy of the test sound S received by the microphone 20 does not exceed the predetermined energy value. On the other hand, when the sound collection equipment 1 is not in the usage state, the distance between the speaker 10 and the microphone 20 is shorter than the predetermined distance. Thus, the energy of the test sound S received by the microphone 20 exceeds the predetermined energy value. As a result, when the energy of the test sound S does not exceed the predetermined energy value, it is judged that the sound collection equipment 1 is in the usage state (step S4). When the energy of the test sound S exceeds the predetermined energy value, it is judged that the sound collection equipment 1 is not in the usage state (step S5).

Figure 5:
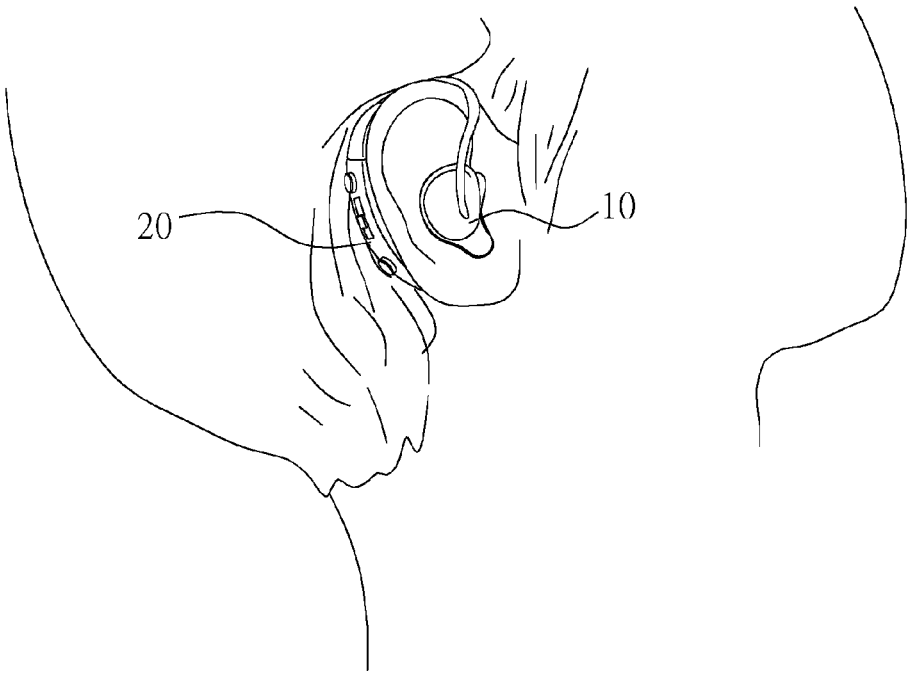
FIG. 5 is a schematic diagram of the second embodiment indicating that the electronic device is in a usage state.
Figure 6:
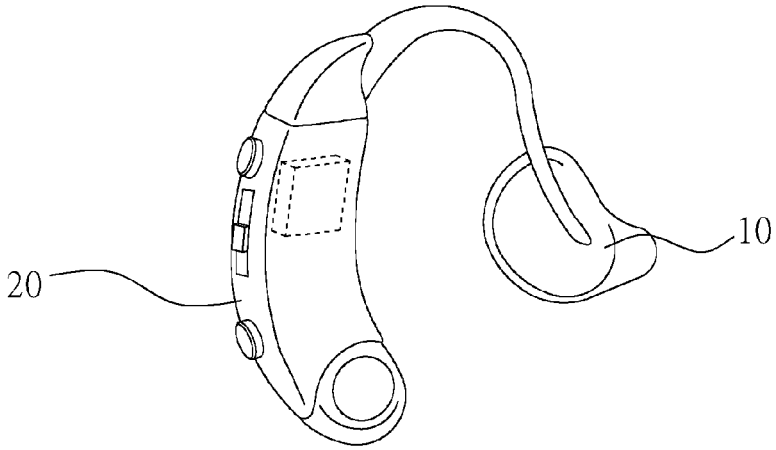
FIG. 6 is a schematic diagram of the second embodiment indicating that the electronic device is not in a usage state.

As shown in FIG. 1 and FIG. 5, in another embodiment of the present invention, when a user uses the sound collection equipment 1, i.e., the sound collection equipment 1 is in the usage state, the speaker 10 of the sound collection equipment 1 is placed near the ears, and the microphone 20 is placed at the back of the ear. The speaker 10 and the microphone 20 are blocked by the auricle. On the other hand, as shown in FIG. 6, once the user removes the sound collection equipment 1 from the ear, the speaker 10 and the microphone 20 are not blocked by any objects. Accordingly, the sound collection equipment 1 being in the usage state refers to an object being located between the speaker and the microphone of the sound collection equipment 1. When the sound collection equipment 1 is in the usage state, the speaker 10 and the microphone 20 of the sound collection equipment 1 are blocked by an object, and the energy value of the test sound S received by the microphone 20 does not exceed a predetermined energy value. On the other hand, when the sound collection equipment 1 is not in the usage state, the speaker 10 and the microphone 20 of the sound collection equipment 1 are not blocked by an object, and the energy value of the test sound S received by the microphone 20 exceeds a predetermined energy value. When it is determined that the energy of the test sound S does not exceed a predetermined energy value, it is judged that the sound collection equipment 1 is in the usage state (step S4). On the other hand, when it is determined that the energy of the test sound S exceeds a predetermined energy value, it is judged that the sound collection equipment 1 is not in the usage state (step S5).

Execute step S6: controlling the sound amplifier to stop amplifying the sound received by the microphone or to reduce an amplification level of the sound received by the microphone.

Once it is determined that the sound collection equipment 1 is not in the usage state, the micro controller 32 of the processor unit 30 controls the sound amplifier 40 to stop amplifying the sound received by the microphone 20 or to reduce an amplification level of the sound received by the microphone 20 in order to prevent the audio feedback resulting from the speaker 10 and the microphone 20 being placed too close to each other.

According to the above description, the method for detecting an operating state of a sound collection equipment of the present invention is to judge if the sound collection equipment 1 is in the usage state by determining the energy level of the test sound S and to stop amplifying the sound received by the microphone or to reduce an amplification level of the sound received by the microphone so as to prevent the audio feedback from occurring when the sound collection equipment 1 is not in the usage state.

While the present invention has been particularly shown and described with reference to a preferred embodiment, it will be understood by those skilled in the art that various changes and modifications can be made to the described embodiments. It is intended to include all such variations, modifications and equivalents which fall within the scope of the invention, as defined in the accompanying claims. It is to be understood that many other possible modifications and variations can be made without departing from the spirit and scope of the invention as hereinafter claimed.

What is claimed is:

1. A sound collection equipment, comprising:

a speaker used for generating a test sound;

a microphone used for receiving the test sound; and a processor unit electrically connected to the speaker and the microphone, used for determining if the energy of the test sound received by the microphone exceeds a predetermined energy value and judging that the sound collection equipment is in a usage state when the test sound does not exceed the predetermined energy value.

2. The sound collection equipment of claim 1, wherein the test sound is a high frequency sound, a frequency of the test sound ranging between 8,000~40,000 Hz.

3. The sound collection equipment of claim 1, wherein the sound collection equipment further comprises a sound amplifier, the sound amplifier being electrically connected to the processor unit; when the sound collection equipment is judged to be in the usage state, the processor unit further controls the sound amplifier to stop amplifying sounds received by the microphone or reduces an amplification level of the sounds received by the microphone.

4. The sound collection equipment of claim 1, wherein the sound collection equipment being in the usage state refers to the speaker being at or exceeding a predetermined distance from the microphone.

5. The sound collection equipment of claim 1, wherein the sound collection equipment being in the usage state refers to an object being located between the speaker and the microphone.

6. A method for detecting an operating state of a sound collection equipment, applicable to a sound collection equipment, the sound collection equipment comprising a speaker and a microphone, the method comprising the following steps:

generating a test sound via the speaker;

receiving the test sound via the microphone; and determining if the energy of the test sound received by the microphone exceeds a predetermined energy value;

whereby with the above steps, if the energy of the test sound does not exceed a predetermined energy value, judging the sound collection equipment to be in a usage state, and if the energy of the test sound exceeds the predetermined energy value, judging the sound collection equipment not to be in the usage state.

7. The method of claim 6, wherein the test sound is a high frequency sound, a frequency of the test sound ranging between 8,000~40,000 Hz.

8. The method of claim 6, wherein the sound collection equipment further comprises a sound amplifier, the sound amplifier being electrically connected to a processor unit; when the sound collection equipment is judged to be in the usage state, the processor unit controls the sound amplifier to stop amplifying the sound received by the microphone or to reduce an amplification level of the sound received by the microphone.

9. The method of claim 6, wherein the sound collection equipment being in the usage state refers to the speaker being at or exceeding a predetermined distance from the microphone.

10. The method of claim 6, wherein the sound collection equipment being in the usage state refers to an object being located between the speaker and the microphone.

* * * * *